US010506672B2

(12) United States Patent
Mazzon

(10) Patent No.: US 10,506,672 B2
(45) Date of Patent: Dec. 10, 2019

(54) MICROWAVE OVEN WITH A WAVEGUIDE INCLUDING A REFLECTOR ELEMENT

(71) Applicant: Electrolux Appliances Aktiebolag, Stockholm (SE)

(72) Inventor: Claudio Mazzon, Rothenburg ob der Tauber (DE)

(73) Assignee: Electrolux Appliances Aktiebolag, Stockholm (SE)

( * ) Notice: Subject to any disclaimer, the term of this patent is extended or adjusted under 35 U.S.C. 154(b) by 315 days.

(21) Appl. No.: 15/126,841

(22) PCT Filed: Apr. 1, 2015

(86) PCT No.: PCT/EP2015/057176

§ 371 (c)(1),
(2) Date: Sep. 16, 2016

(87) PCT Pub. No.: WO2015/180874

PCT Pub. Date: Dec. 3, 2015

(65) Prior Publication Data

US 2017/0099705 A1 Apr. 6, 2017

(30) Foreign Application Priority Data

May 26, 2014 (EP) ..... 14169822

(51) Int. Cl.
*H05B 6/70* (2006.01)

(52) U.S. Cl.
CPC ..... *H05B 6/707* (2013.01)

(58) Field of Classification Search
CPC ..... H05B 6/707; H05B 6/70; H05B 6/64
USPC ..... 219/690–701, 746, 756–758, 770, 771
See application file for complete search history.

(56) References Cited

U.S. PATENT DOCUMENTS

| | | | | |
|---|---|---|---|---|
| 3,670,134 | A * | 6/1972 | Bucksbaum | H05B 6/705 219/704 |
| 4,808,784 | A * | 2/1989 | Ko | H05B 6/707 219/746 |
| 4,967,050 | A | 10/1990 | Okamoto et al. | |
| 6,888,114 | B2 * | 5/2005 | Yagi | H05B 6/707 219/695 |
| 6,900,422 | B2 | 5/2005 | Herold et al. | |
| 7,820,953 | B2 | 10/2010 | Lee | |
| 8,513,579 | B2 | 8/2013 | Byun | |

(Continued)

FOREIGN PATENT DOCUMENTS

| | | |
|---|---|---|
| DE | 4230522 A1 | 3/1994 |
| EP | 1196010 A1 | 4/2002 |
| EP | 2268104 A1 | 12/2010 |

OTHER PUBLICATIONS

International Search Report issued in PCT/EP2015/057176 dated Jul. 6, 2015, 3 pages.

*Primary Examiner* — Christopher S Kim
(74) *Attorney, Agent, or Firm* — Pearne & Gordon LLP

(57) ABSTRACT

The invention relates to a microwave oven comprising an oven cavity (2), a microwave generator (3) for generating microwaves and a waveguide (4) for guiding the microwaves to the oven cavity (2), wherein the waveguide (4) includes a reflector element (5) comprising a plurality of reflection surfaces (5.2), the reflector element (5) being fixedly arranged within the waveguide (4) or integrated in the waveguide wall in order to reflect the microwaves into the oven cavity (2) in a distributed manner.

14 Claims, 2 Drawing Sheets

(56) References Cited

U.S. PATENT DOCUMENTS

| | | | |
|---|---|---|---|
| 8,729,441 | B2 | 5/2014 | Kanzaki et al. |
| 9,307,583 | B2 | 4/2016 | Sim et al. |
| 9,491,811 | B2 | 11/2016 | Sim et al. |
| 9,674,903 | B2 | 6/2017 | Moon et al. |
| 2012/0241445 | A1 | 9/2012 | Shim et al. |
| 2013/0206752 | A1 | 8/2013 | Moon et al. |
| 2015/0034632 | A1 | 2/2015 | Brill et al. |
| 2016/0192446 | A1 | 6/2016 | Seddik |
| 2017/0099705 | A1 | 4/2017 | Mazzon |
| 2017/0164429 | A1 | 6/2017 | Lerosey et al. |
| 2017/0257914 | A1 | 9/2017 | Nikishov et al. |
| 2018/0359823 | A1 | 12/2018 | Shin et al. |

* cited by examiner

MICROWAVE OVEN WITH A WAVEGUIDE INCLUDING A REFLECTOR ELEMENT

The present invention relates generally to the field of microwave ovens. More specifically, the present invention is related to an enhanced microwave distribution within microwave ovens.

BACKGROUND OF THE INVENTION

Microwave ovens for preparing food are well known in prior art. Typically, uniform energy distribution within microwave ovens is desired because the food to be prepared should be heated uniformly. In addition a maximized power transfer to the food to be prepared should be achieved thereby keeping the microwave generator of the microwave oven working in the allowed impedance region.

Microwave ovens may comprise a turntable, on which the food to be prepared is located. By rotating the turntable, an evenly distributed heating of the food is obtained. Another type of microwave ovens comprises mode stirrers to achieve uniform heating. Said microwave ovens allow a variation of the working point of the microwave generator avoiding a critical operation in case of a mismatched load or even no load.

Impedance matching between the microwave generator and the oven cavity is obtained by a proper dimensioning and shaping of the interface between the oven cavity and the waveguide connecting the microwave generator with the oven cavity.

A drawback of the known microwave ovens is that rotating elements driven by a motor are necessary in order to obtain uniform heating, respectively, avoid critical operation in case of a mismatched load.

SUMMARY OF THE INVENTION

It is an objective of embodiments of the invention to provide technically simple and inexpensive means for impedance matching between the microwave generator and the oven cavity and for enhancing the microwave distribution within the oven cavity. The objective is solved by the features of the independent claims. Preferred embodiments are given in the dependent claims. If not explicitly indicated otherwise, embodiments of the invention can be freely combined with each other.

According to a first aspect, a microwave oven is disclosed. The microwave oven comprises an oven cavity, a microwave generator for generating microwaves and a waveguide for guiding the microwaves to the oven cavity. The waveguide includes a reflector element comprising a plurality of reflection surfaces, the reflector element being fixedly arranged within the waveguide or integrated in the waveguide wall in order to reflect the microwaves into the oven cavity in a distributed manner. By means of the reflector element, a scattering of the microwaves is obtained thereby leading to a uniform microwave distribution within the oven cavity without any rotating elements. In addition, a means of impedance matching between the microwave generator and the oven cavity is achieved.

According to embodiments, the reflection surfaces are slanted with respect to the surface of the waveguide on which the reflector element is located. The reflection surfaces may be slanted by an angle between 0° and 90°, preferably between 0° and 60°, most preferably between 0° and 45° with respect to the surface of the waveguide on which the reflector element is located. Thereby, microwaves propagating through the waveguide are reflected out of the waveguide through an opening into the oven cavity. Even multiple reflections between the reflector element and the walls of the waveguide may be achieved thereby enhancing the microwave distribution within the oven cavity.

According to embodiments, the reflection surfaces are rotation-symmetrically arranged with respect to the central axis of the reflector element. Thereby a reflector element is obtained which is rotation-symmetrical and can be placed in a corresponding portion of the waveguide in order to enhance the coupling between the waveguide and the oven cavity. In addition, the scattering behavior of the reflector element is optimized.

According to embodiments, the reflection surfaces are circumferentially arranged at the reflector element. Specifically, reflection surfaces may be arranged at the whole circumference of the reflector element. Microwaves propagating through the waveguide may directly hit the reflector element or may indirectly hit the reflector element after being reflected by the waveguide walls. Thereby, also reflection surfaces being arranged at the far side of the microwave generator may contribute to the scattering effect of the reflector element.

According to embodiments, the reflection surfaces comprise a rhombic shape. According to other embodiments, the reflection surfaces comprise a triangular, rectangular, trapezoid or polygonal shape. The shape of the reflection surfaces may depend on the shaping of the waveguide, the position of the reflection element and the interface to the oven cavity.

According to embodiments, the reflector element comprises a truncated pyramid shape or a pyramid-like shape. The base of the reflector element may be triangular, rectangular, polygonal etc. Alternatively, the reflector element comprises a truncated cone shape or a cone-like shape. The reflection surfaces may be arranged at the lateral surface of said reflector element.

According to embodiments, the edges of the reflector element comprise a length between $\lambda$ and $\lambda/12$, wherein $\lambda$ is the wavelength of the microwaves. By choosing said dimensioning rule, an improved impedance matching, respectively, coupling of the microwaves into the oven cavity is obtained.

According to embodiments, the reflector element comprises multiple groups of reflection surfaces and wherein each group of reflection surfaces comprises the same or different inclination or tilt angle. For example, the reflector element may comprise several rows of reflection surfaces, said rows being arranged one above another. Thereby an improved scattering effect is obtained.

According to embodiments, the waveguide comprises a feed-in area at which the microwave generator is arranged and a coupling area at which the microwaves are coupled into the oven cavity, wherein the reflector element is located in the coupling area and the coupling area can comprise a comparable or a greater width than the feed-in area. By widening the waveguide in the coupling area, the coupling efficiency and the scattering effect of the reflector element is enhanced and a constant wave impedance of the waveguide is achieved even when inserting the reflector element.

According to embodiments, the waveguide comprises a feed-in area at which the microwave generator is arranged and a coupling area at which the microwaves are coupled into the oven cavity, wherein the coupling area can comprise comparable or a greater height than the feed-in area. Said greater height of the waveguide in the coupling area is advantageous because a reflector element with a larger volume can be used in order to enhance the scattering effect.

According to embodiments, the coupling area comprises a cup-like shape. Thereby, a reflector element with a rotation-symmetrical shape may be used which reflects microwaves from different regions of the coupling area and/or different directions into the oven cavity. Furthermore, said cup-like shape is advantageous because an improved impedance matching is obtained.

According to embodiments, the reflector element is made of metal. Alternatively, the reflector element may be made of any electromagnetic reflective material.

According to embodiments, the reflector element is arranged opposite to an opening of the oven cavity through which the microwaves are transmitted into the oven cavity. Said opening may be in the upper wall of the oven cavity. By means of the reflector element, the microwaves propagating within the waveguide may be reflected into the oven cavity through the opening. Due to the plurality of reflection surfaces and the shape of the waveguide the microwaves may be reflected in different directions into the oven cavity thereby achieving a uniform microwave distribution within the oven cavity.

According to a further aspect, a waveguide for a microwave oven is disclosed. The waveguide comprises a feed-in area for coupling with a microwave generator and a radiation area for coupling microwaves generated by the microwave generator into the oven cavity. The waveguide includes a reflector element comprising a plurality of reflection surfaces, the reflector element being fixedly arranged within the waveguide or integrated in the waveguide wall in order to reflect the microwaves into the oven cavity in a distributed manner.

The term "essentially" or "approximately" as used in the invention means deviations from the exact value by +/−10%, preferably by +/−5% and/or deviations in the form of changes that are insignificant for the function.

BRIEF DESCRIPTION OF THE DRAWINGS

The various aspects of the invention, including its particular features and advantages, will be readily understood from the following detailed description and the accompanying drawings, in which.

DETAILED DESCRIPTION OF PREFERRED EMBODIMENTS

Figure 1:
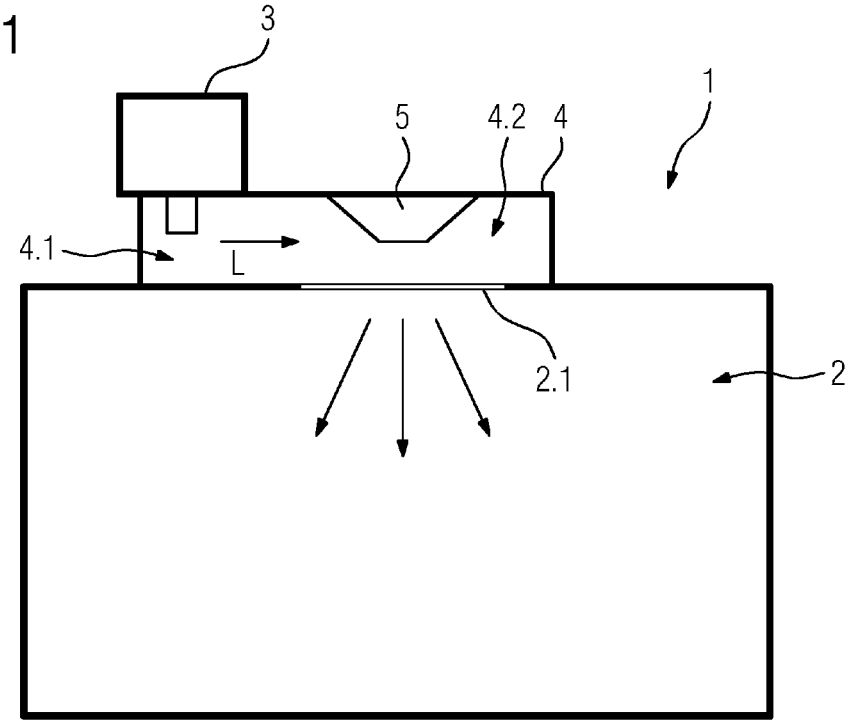
FIG. 1 shows schematic diagram of a microwave oven.

The present invention will now be described more fully with reference to the accompanying drawings, in which example embodiments are shown. However, this invention should not be construed as limited to the embodiments set forth herein. Throughout the following description similar reference numerals have been used to denote similar elements, parts, items or features, when applicable.

FIG. 1 shows a schematic diagram of a microwave oven 1. The microwave oven 1 comprises an oven cavity 2 adapted to receive food to be heated up, a microwave generator 3 adapted to generate microwaves (electromagnetic waves with a wavelength of 10 cm-40 cm) and a waveguide 4 for coupling the microwave generator 3 with the oven cavity 2. The waveguide 4 may be a rectangular waveguide or a launcher. The microwave generator 3 may be constituted by a magnetron.

The waveguide 4 may comprise a feed-in area 4.1 at which the microwaves are coupled in. The microwaves generated by the microwave generator 3 may propagate in a longitudinal direction L of the waveguide 4 from the feed-in area 4.1 to a coupling area 4.2 at which the microwaves are coupled from the waveguide 4 into the oven cavity 2 via an opening 2.1 in the cavity wall. The opening may be arranged in the upper cavity wall of the oven cavity 2.

In order to obtain a uniform microwave distribution within the oven cavity 2 and thus a uniform heating of the food to be prepared, the waveguide 4 comprises a reflector element 5. The reflector element 5 is arranged at a distance to the microwave generator 3 in the coupling area 4.2. The reflector element 5 is fixedly arranged at the waveguide 4 or is an integral part of the waveguide wall. More in detail, the reflector element 5 may be directly arranged at an outer wall of the waveguide 4, the outer wall being arranged at a distance to the cavity wall comprising the opening 2.1. The reflector element 5 may comprise a base surface 5.1 which is directly attached to a wall portion of the waveguide 4. According to another embodiment, the reflector element 5 may be constituted by a wall portion of the waveguide wall, i.e. the reflector element 5 is integrally formed with a wall portion of the waveguide 4.

The reflector element 5 comprises a plurality of reflection surfaces 5.2 by means of which the microwaves transmitted by the microwave generator 3 are reflected in a plurality of different directions. Therefore, the microwaves are distributed within the oven cavity 2 without any moving or rotating parts and a uniform heating of the food to be prepared is obtained. The reflection surfaces 5.2 may be slanted with respect to the waveguide surface on which the reflector element 5 is arranged. In other words, the reflection surfaces 5.2 may be slanted with respect to the waveguide wall being opposite to the opening 2.1, respectively, slanted to the base surface 5.1 of the reflector element 5. The tilt angle of the reflection surfaces 5.2 may be in the range of 0° to 90° with respect to a horizontal plane. Thus, microwaves propagating in the longitudinal direction L of the waveguide 4 may be reflected at the reflection surfaces 5.2 and may propagate into the oven cavity 2 through the opening 2.1.

Figure 2:
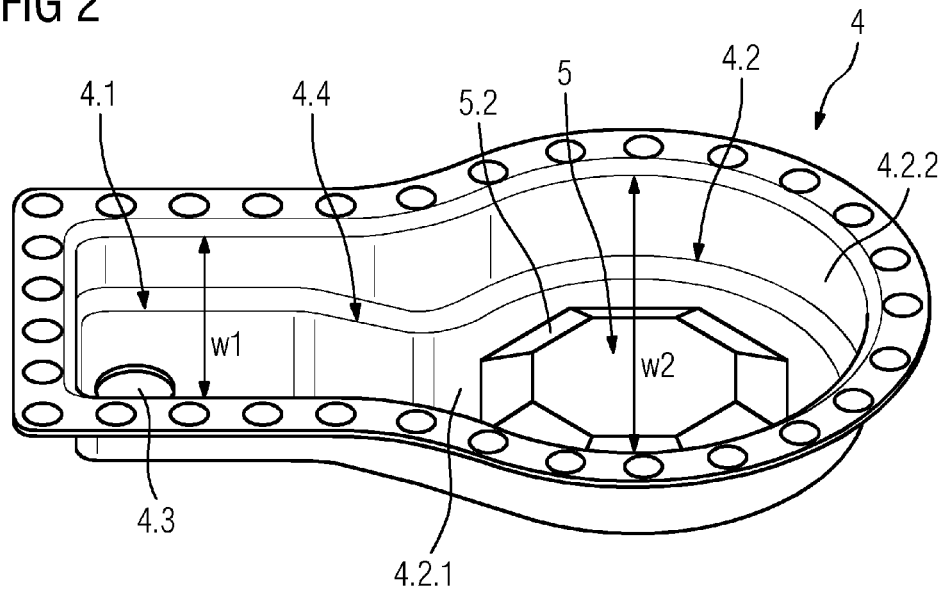
FIG. 2 shows a waveguide with a reflector element in a first perspective view.
Figure 3:
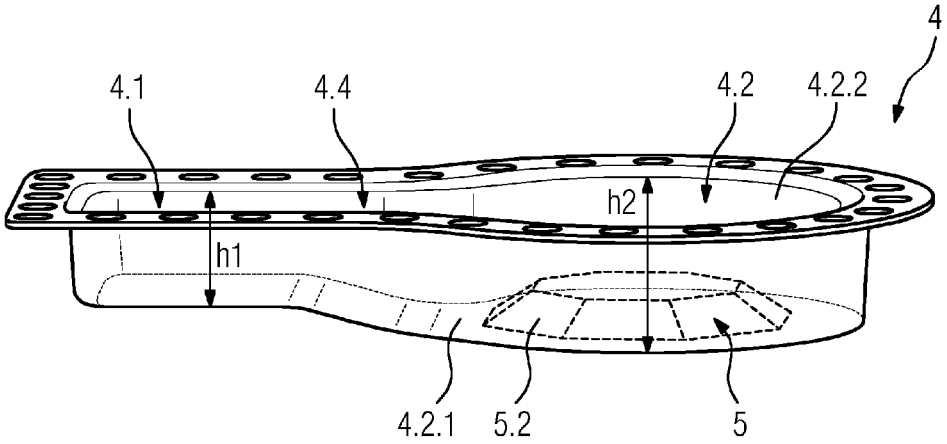
FIG. 3 shows a waveguide with a reflector element in a second perspective view.

FIGS. 2 and 3 show the waveguide 4 including the reflector element 5 in closer detail. The waveguide 4 may be a deep-drawn part made of sheet metal. The waveguide 4 may include a flange for connecting the waveguide 4 to the outer side of the wall of the oven cavity 2. The waveguide 4 comprises at its feed-in area 4.1 an opening 4.3 through which the antenna of the microwave generator 3 may protrude into the waveguide 4. The feed-in area 4.1 may comprise a cuboid shape with a width w1 and a height h1. The feed-in area 4.1 may be coupled with the coupling area 4.2 of the waveguide 4 by means of a transition area 4.4.

By means of the transition area 4.4, the waveguide 4 may widen from width w1 to width w2 and height h1 to h2, wherein h2>h1 and w2>w1. In other words, the coupling area 4.2 comprises a greater cross-sectional area than the feed-in area 4.1, wherein said cross-sectional area is perpendicular to the longitudinal direction L of the waveguide 4.

The coupling area 4.2 may comprise a cup-like or essentially cup-like shape. For example, the waveguide 4 in the coupling area 4.2 may comprise a circular or essentially circular base 4.2.1 and a lateral surface 4.2.2 which protrudes vertically from the base 4.2.1. According to a first embodiment, the reflector element 5 is fixedly arranged at the base 4.2.1, wherein the base surface 5.1 of the reflector element 5 directly abuts against the base 4.2.1 and is fixedly arranged at said base 4.2.1. According to another embodiment, the reflector element 5 is an integral part of the waveguide 4, specifically the base 4.2.1, for example obtained by deep-drawing. The reflector element 5 may be concentrically arranged within the coupling area 4.2 in order to obtain an optimized matching of the impedance of the microwave generator 3 to the oven cavity 2.

Figure 4:
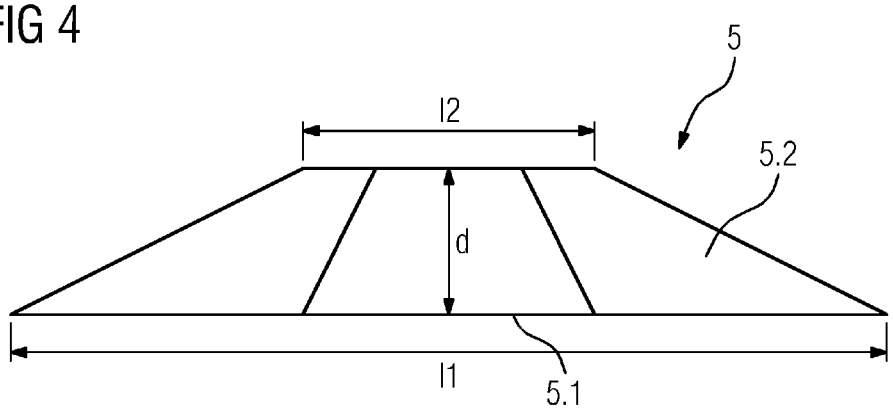
FIG. 4 shows a schematic diagram of a reflector element.

As shown in FIG. 2-4, the reflector element 5 comprises a three-dimensional structure with a plurality of reflection surfaces 5.2. The reflector element 5 may comprise a rotationally symmetric shape with respect to a vertical central axis of the reflector element 5 being arranged perpendicular to the base 4.2.1. The reflection surfaces 5.2 may be circumferentially arranged at the reflector element 5, i.e. the reflection surfaces 5.2 comprise different orientations within the waveguide 4 leading to a scattering of the microwaves and thus a uniform distribution of the microwaves within the oven cavity 2. In the present embodiment, the reflector element 5 has a truncated pyramid shape with a plurality of reflection surfaces 5.2 with trapezoidal shape. According to further embodiments, the reflection surfaces 5.2 may comprise a triangular, rectangular, polygonal or rhombic shape.

According to the present embodiment, the reflection surfaces 5.2 are arranged in a single row at the reflector element 5. According to other embodiments, the reflection surfaces 5.2 may be arranged in multiple groups, wherein each group of reflection surfaces 5.2 is arranged in a different row. The reflection surfaces 5.2 may also have different tilt angles, for example, different tilt angles for each row. The number of reflection surfaces 5.2 and the tilt angles may vary dependent on the geometry of the oven cavity 2 and the waveguide 4. Furthermore, the geometry of the reflector element 5 and the reflection surfaces 5.2 may be adapted to the wavelength of the microwaves generated by the microwave generator 3. For example, the dimensions l1, l2 and d may be in the range between $\lambda$ and $\lambda/12$ in order to obtain an optimized reflection behaviour of the reflector element.

Above, embodiments of a microwave oven and a waveguide according to the present invention as defined in the appended claims have been described. These should be seen as merely non-limiting examples. As understood by a skilled person, many modifications and alternative embodiments are possible within the scope of the invention.

LIST OF REFERENCE NUMERALS

1 microwave oven
2 oven cavity
2.1 opening
3 microwave generator
4 waveguide
4.1 feed-in area
4.2 coupling area
4.2.1 base
4.2.2 lateral surface
4.3 opening
4.4 transition area
5 reflector element
5.1 base surface
5.2 reflection surface
d width
h1 height
h2 height
l1 length
l2 length
L longitudinal direction
w1 width
w2 width

The invention claimed is:

1. Microwave oven comprising an oven cavity, a microwave generator for generating microwaves and a waveguide for guiding the microwaves to the oven cavity, wherein the waveguide includes a feed-in area and a coupling area, the coupling area having a circular base and a wall extending from a perimeter of the circular base, a reflector element comprising a plurality of reflection surfaces being arranged in the coupling area of the waveguide, the reflector element being fixedly arranged within the waveguide or integrated in a wall of the waveguide in order to reflect the microwaves into the oven cavity in a distributed manner.

2. Microwave oven according to claim 1, wherein the reflection surfaces are slanted with respect to a base of the waveguide on which the reflector element is located.

3. Microwave oven according to claim 1, wherein the reflection surfaces are rotation-symmetrically arranged with respect to a central axis of the reflector element.

4. Microwave oven according to claim 1, wherein the reflection surfaces are circumferentially arranged at the reflector element.

5. Microwave oven according to claim 1, wherein the reflection surfaces are rhombic surfaces.

6. Microwave oven according to claim 1, wherein the reflection surfaces comprise a triangular, rectangular, trapezoidal or polygonal shape.

7. Microwave oven according to claim 1, wherein the reflector element comprises a truncated pyramid shape.

8. Microwave oven according to claim 1, wherein edges of the reflector element comprise a length between $\lambda$ and $\lambda/12$, wherein $\lambda$ is a wavelength of microwaves generated by said microwave generator.

9. Microwave oven according to claim 1, wherein the reflector element comprises multiple groups of reflection surfaces and wherein each group of reflection surfaces comprises a different inclination angle.

10. Microwave oven according to claim 1, said microwave generator being arranged at said feed-in area of the waveguide, wherein microwaves generated by said microwave generator are coupled into the oven cavity at said coupling area of said waveguide, the coupling area having a greater width than the feed-in area.

11. Microwave oven according to claim 1, said microwave generator being arranged at said feed-in area of the waveguide, wherein microwaves generated by said microwave generator are coupled into the oven cavity at said coupling area of said waveguide, the coupling area having a greater height than the feed-in area.

12. Microwave oven according to claim 1, wherein the reflector element is made of metal.

13. Microwave oven according to claim 1, wherein the reflector element is arranged opposite to an opening of the oven cavity through which the microwaves are transmitted into the oven cavity.

14. Waveguide for a microwave oven comprising a feed-in area for coupling with a microwave generator and radiation area having a circular base and a wall extending from a perimeter of the circular base for coupling microwaves generated by the microwave generator into the oven cavity, wherein the waveguide includes a reflector element comprising a plurality of reflection surfaces arranged in the radiation area of the waveguide, the reflector element being fixedly arranged within the waveguide or integrated in a wall of the waveguide in order to reflect the microwaves into the oven cavity in a distributed manner.

* * * * *